US006676292B2

(12) United States Patent
Stephany et al.

(10) Patent No.: US 6,676,292 B2
(45) Date of Patent: Jan. 13, 2004

(54) PACKAGING ENCLOSURE FOR CONTAINING AN ARTICLE OF MANUFACTURE

(75) Inventors: Thomas M. Stephany, Churchville, NY (US); Daniel C. Robeson, Canandaigua, NY (US); Richard W. Wien, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/151,739

(22) Filed: May 20, 2002

(65) Prior Publication Data

US 2003/0215164 A1 Nov. 20, 2003

(51) Int. Cl.[7] ..... B65D 33/34
(52) U.S. Cl. ..... 383/5; 383/9; 383/200
(58) Field of Search ..... 383/9, 14, 201, 383/202, 207, 200, 5

(56) References Cited

U.S. PATENT DOCUMENTS 3,309,007 A * 3/1967 Rosenberg et al. ..... 383/9
3,854,584 A 12/1974 Olson
4,072,233 A * 2/1978 Kramer et al. ..... 383/202
4,715,728 A * 12/1987 Sfikas ..... 383/9
4,762,514 A * 8/1988 Yoshida ..... 493/227
4,898,280 A * 2/1990 Runge ..... 383/200
5,267,643 A 12/1993 Scribner
5,307,955 A 5/1994 Viegas
5,525,363 A * 6/1996 Herber et al. ..... 426/130
5,862,944 A * 1/1999 Scherr ..... 221/63
5,997,177 A * 12/1999 Kaufman ..... 383/5
6,076,967 A * 6/2000 Beaudette ..... 383/41

* cited by examiner

*Primary Examiner*—Jes F. Pascua
(74) *Attorney, Agent, or Firm*—Peyton C. Watkins

(57) ABSTRACT

A packaging enclosure for containing an article of manufacture, the packaging enclosure includes an enclosed enclosure formed from a sheet material having an internal side forming a boundary for an internal portion of the enclosure which internal side includes a notched portion that is manually removable by an end user.

2 Claims, 3 Drawing Sheets

PACKAGING ENCLOSURE FOR CONTAINING AN ARTICLE OF MANUFACTURE

FIELD OF THE INVENTION

The invention relates to packing enclosures and, more particularly, to such packaging material having a side with a notched portion adjacent to an internal portion of the enclosure for manual removal by an end user.

BACKGROUND OF TIE INVENTION

It is also common practice in the industry to provide merchandise for sale in boxes, pouches and the like. These particular-chosen contained will typically also include some sort of breakable seal for providing easy access to the merchandise inside the particular container. The consumer takes the merchandise home, opens the container and either consumes the contents or partially uses the contents and stores the opened container with the remainder of the unused merchandise on a shelf. In the case of merchandise, which is used over a longer period of time, storing the package is problematic especially for things such as cleaning products and the like.

Although the presently known and utilized containers are satisfactory, they include drawbacks. Such containers are only suitable for shelf-like storage that limits consumer's options for using a package over a long period of time.

Consequently, a need exists for containers that can be stored on hooks and the like.

SUMMARY OF THE INVENTION

The present invention is directed to overcoming one or more of the problems set forth above. Briefly summarized, according to one aspect of the present invention, the invention resides in a packaging enclosure for containing an article of manufacture, the packaging enclosure comprising (a) an enclosed enclosure formed from a sheet material having an internal side forming a boundary for an internal portion of the enclosure which internal side includes a notched portion that is manually removable by an end user.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
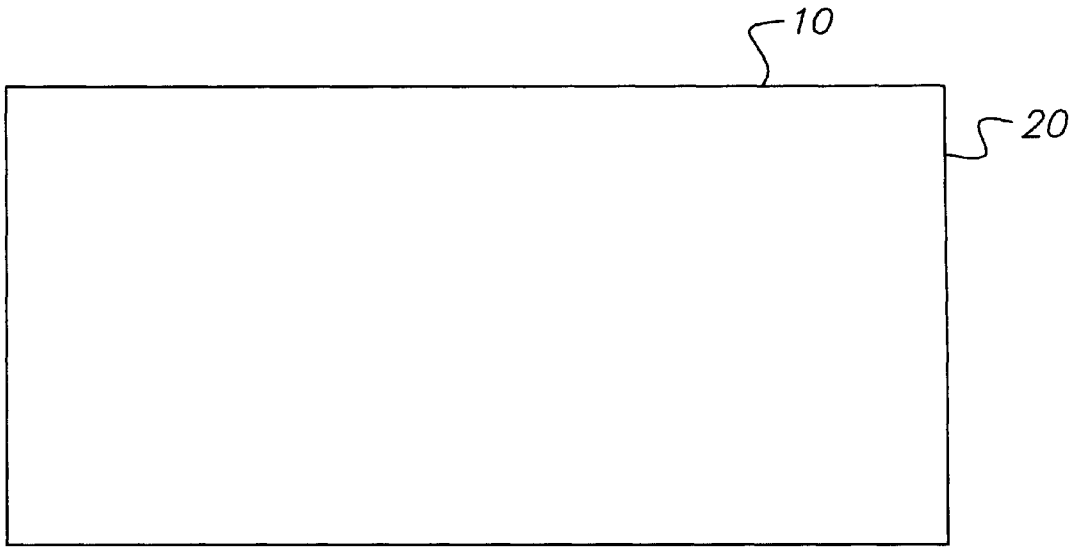
FIG. 1 is a top view of a single sheet of biaxially oriented packaging material in its original form that is used to construct a package of the present invention.

Referring to FIG. 1 there is shown a sheet 10 of biaxially oriented polypropylene material of the type generally used in the construction of thermally formed packages. This type of material is generally available from a plurality of manufacturers such as Applied Extrusion Technologies of Norcross, Ga., 30092-3383. Typically, a sheet of the said material is cut into a single sheet 20 of a size that is necessary for a particular package. An example of a product application for the package of the present invention is, for example, dusting cloths.

Figure 2:
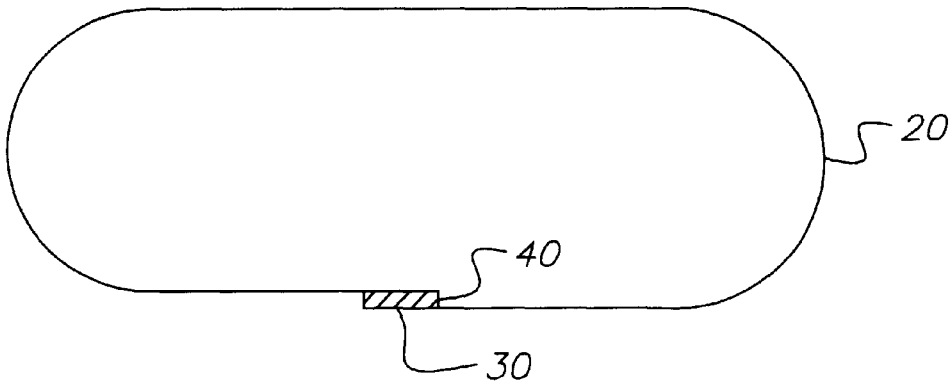
FIG. 2 is an end view of the single sheet of the biaxially oriented packaging material folded over to detail an overlapping area in end view in which ends of the material are thermally attached to each other along the length of the package of the present invention.
Figure 3:
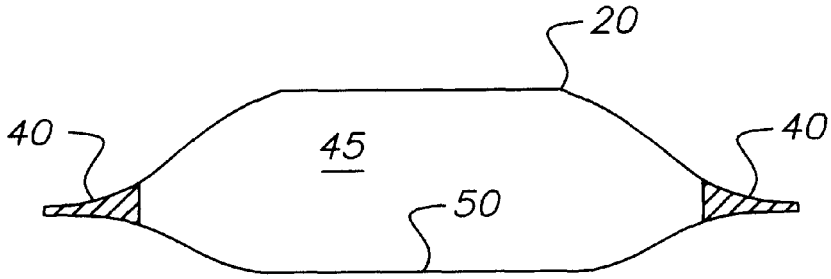
FIG. 3 illustrates the partially formed package of FIG. 2 rotated 90 degrees in side view showing the thermally formed ends of the package creating a complete package of the present invention.
Figure 4:
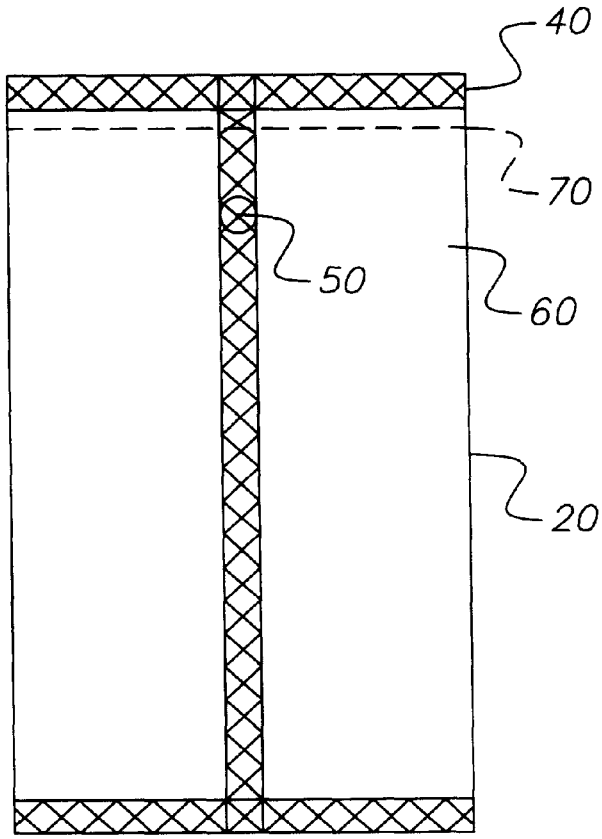
FIG. 4 is a bottom view of the formed package showing a typical placement of the user-breakable seal of the present invention, placed along the length of the first thermal seal detailed in FIG. 1.

Referring next to FIG. 2, which shows an end view of the package, the biaxially oriented polypropylene 20 is rolled to form an overlap 30 which is thermally welded or attached together 40. This operation forms the length of the package containing the particular product. Referring now to FIG. 3, which shows the partially formed package in side view, after the insertion of a product, the biaxially oriented polypropylene 20, is thermally welded 40 on the top and bottom of the package thus completing the package construction. The completed package includes an interior portion 45 into which contents may be inserted and a pre-formed notch portion 50 the internal side of the package adjacent the interior 45 for providing a mechanism for hanging the package on a hook or the like, as described in detail hereinbelow. Referring now to FIG. 4, a bottom view of a completed package 60 is shown. The completed package 60 that is constructed from the polyethylene 20 shows all of the thermal welds 40 as described herein above, required construct a complete assembly. An access mechanism in the form of die cut portion 70 preferably exists on the external side opposite the pre-formed notch 50 to aid a consumer to remove the contents of package 60.

Referring again to FIGS. 3, 4 and 5, the present invention is detailed as a pre-formed notch 50 is shown situated upon the length of the package's 60 thermal weld 40 in an effort to allow the package to be hung upon an appendage such as a hook or nail. The pre-formed notch 50 is, for reasons of providing a tamper-evident mechanism, is more easily removable from inside the package 60 after accessing via the die cut portion 70. The interior 45 of package 60 is accessible by either a perforation, a self sealing portion, a marked portion for manual cutting, or a ripping portion the customer by tearing the die scored portion 70. It should be noted here that the scored portion 70 for the removal of package contents could be constructed as either a perforation, a self sealing portion, a marked portion for manual cutting, or a ripping portion.

Figure 5A:
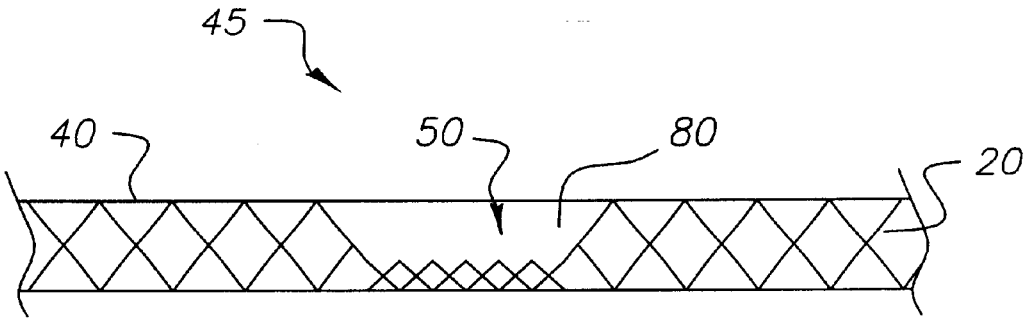
FIG. 5*a*, FIG. 5*b*, and FIG. 5*c* illustrate three side views of alternative embodiments of the user-breakable seal of the present invention.
Figure 5B:
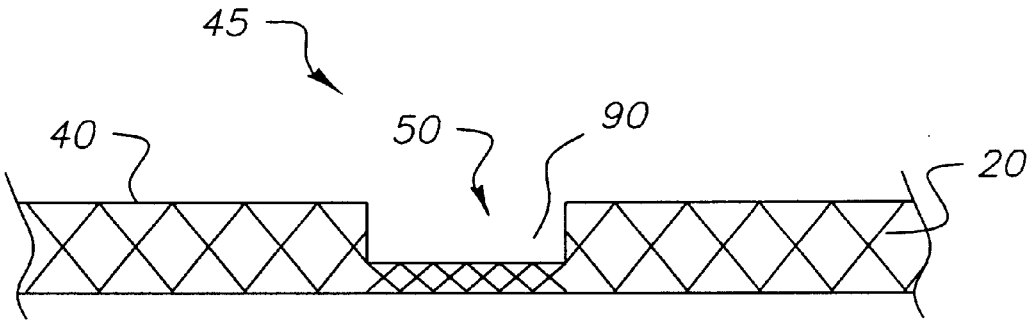
Figure 5C:
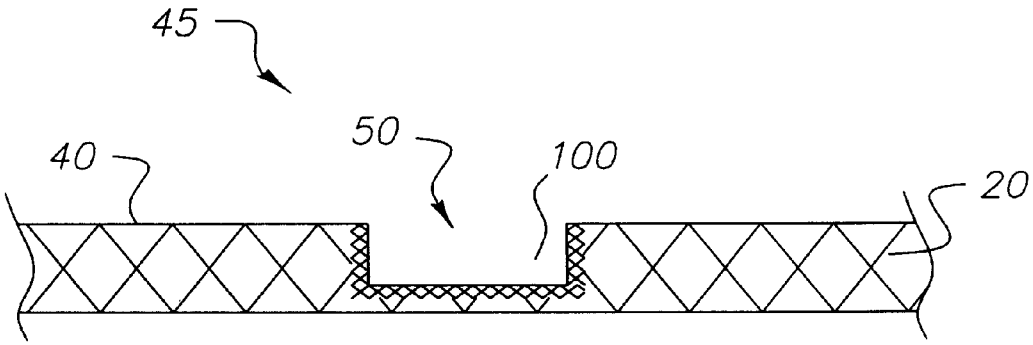

Referring now to FIGS. 5*a*, 5*b*, and 5*c*, detailed are three alternative embodiments to form the pre-formed notch 50. FIG. 5*a* details a partially cut area 80 to aid removal of the pre-formed notch 50 in polypropylene 20, FIG. 5*b* details a mechanically punched area 90 to aid removal of the pre-formed notch 50 in polypropylene 20, and FIG. 5*c* details a partially thermally punched area 100 to aid removal of the pre-formed notch 50 in polypropylene 20. In an effort to further clarify FIGS. 5*a*, 5*b*, and 5*c*, the pre-formed notch 50 is situated upon the length of the package's 60 thermal weld 40 referred to previously in FIG. 5.

The invention has been described in detail with particular reference to certain preferred embodiments thereof, but it will be understood that variations and modifications can be effected within the spirit and scope of the invention.

PARTS LIST

10 biaxially oriented polypropylene

20 single sheet biaxially oriented polypropylene

30 overlap

40 thermal weld

45 interior portion

50 pre-formed notch

60 completed package

70 die cut portion

80 partially cut area

90 mechanically punched area

100 partially thermally punched area

What is claimed is:

1. A packaging enclosure for containing an article of manufacture, the packaging enclosure comprising:

(a) an enclosed enclosure formed from a sheet material having an external side having an access mechanism for opening the packaging enclosure from which the article of manufacture of the packaging enclosure are removed by a user and having an internal side forming a boundary for an internal portion of the enclosure which internal side includes a notched portion that is accessible by a user after opening the packaging enclosure only through the access mechanism and the motched portion is manually removable by a user providing a tamper-resistant mechanism the packaging enclosure to be hung.

2. The packaging enclosure as in claim 1, wherein said notched portion is a compressed area partially through the material, a cut area partially through the material, or a thermally formed dimple partially through the material.

* * * * *

UNITED STATES PATENT AND TRADEMARK OFFICE

CERTIFICATE OF CORRECTION

PATENT NO. : 6,676,292 B2
DATED : January 13, 2004
INVENTOR(S) : Thomas M. Stephany et al.

It is certified that error appears in the above-identified patent and that said Letters Patent is hereby corrected as shown below:

Column 4,
Line 11, “motched” should be corrected to read as -- notched --.
Line 12, “mechanism the packaging” should be corrected to read as -- mechanism for the packaging --.

Signed and Sealed this

Twenty-seventh Day of April, 2004

JON W. DUDAS
*Acting Director of the United States Patent and Trademark Office*